US010408387B2

(12) United States Patent
Bergenek et al.

(10) Patent No.: US 10,408,387 B2
(45) Date of Patent: Sep. 10, 2019

(54) LUMINOUS MEANS HAVING LEDS

(71) Applicant: LEDVANCE GMBH, Garching (DE)

(72) Inventors: Krister Bergenek, Regensburg (DE); Florian Bösl, Regensburg (DE); Andreas Dobner, Wenzenbach (DE); Tobias Schmidt, Augsburg (DE); Andreas Kloss, Neubiberg (DE); Frank Vollkommer, Gauting (DE)

(73) Assignee: LEDVANCE GMBH, Garching (DE)

( * ) Notice: Subject to any disclaimer, the term of this patent is extended or adjusted under 35 U.S.C. 154(b) by 0 days.

(21) Appl. No.: 15/572,434

(22) PCT Filed: Mar. 2, 2016

(86) PCT No.: PCT/EP2016/054361
§ 371 (c)(1),
(2) Date: Nov. 7, 2017

(87) PCT Pub. No.: WO2016/180553
PCT Pub. Date: Nov. 17, 2016

(65) Prior Publication Data

US 2018/0128429 A1 May 10, 2018

(30) Foreign Application Priority Data

May 8, 2015 (DE) ..... 10 2015 208 569

(51) Int. Cl.
*F21K 9/232* (2016.01)
*F21V 5/04* (2006.01)
(Continued)

(52) U.S. Cl.
CPC ..... *F21K 9/232* (2016.08); *F21K 9/65* (2016.08); *F21V 5/04* (2013.01); *F21V 7/0091* (2013.01);
(Continued)

(58) Field of Classification Search
CPC ..... F21K 9/232; F21K 9/69; F21V 29/70; F21V 17/005; F21V 5/04; F21V 7/0091; F21Y 2107/90; F21Y 2115/10
See application file for complete search history.

(56) References Cited

U.S. PATENT DOCUMENTS 7,086,767 B2 * 8/2006 Sidwell ..... F21V 3/00 362/545
8,752,983 B2 * 6/2014 Hussell ..... F21V 29/004 362/249.02
(Continued)

FOREIGN PATENT DOCUMENTS

DE 20 2005 010 490 U1 9/2005
EP 2 251 584 A1 11/2010
(Continued)

OTHER PUBLICATIONS

International Search Report and English language translation dated Apr. 8, 2016, in International Application No. PCT/EP2016/054361 (7 pages).
(Continued)

*Primary Examiner* — Peggy A Neils
(74) *Attorney, Agent, or Firm* — Hayes Soloway PC

(57) ABSTRACT

The present invention relates to a luminous means comprising an enveloping bulb, a base, a first LED and a second LED, which are assembled on a planar printed circuit board, to be precise on the opposite side thereof in relation to a thickness direction, wherein a first diverging lens is mounted on the first side of the printed circuit board in a manner assigned to the first LED and a second diverging lens is mounted on the second side of the printed circuit board in a manner assigned to the second LED for the purposes of homogenizing the light distribution generated by the luminous means, and the light emitted by the respective LED has
(Continued)

a widened luminous intensity distribution downstream of the respective diverging lens in comparison with upstream of the respective diverging lens.

15 Claims, 8 Drawing Sheets

(51) Int. Cl.

| | |
|---|---|
| ***F21V 7/00*** | (2006.01) |
| ***F21V 17/00*** | (2006.01) |
| ***F21V 29/70*** | (2015.01) |
| ***F21K 9/65*** | (2016.01) |
| ***F21Y 115/10*** | (2016.01) |
| ***F21Y 107/90*** | (2016.01) |

(52) U.S. Cl.
CPC ..... *F21V 17/005* (2013.01); *F21V 29/70* (2015.01); *F21Y 2107/90* (2016.08); *F21Y 2115/10* (2016.08)

(56) References Cited

U.S. PATENT DOCUMENTS

| | | | | |
|---|---|---|---|---|
| 9,050,929 | B2 * | 6/2015 | Clifford | B60Q 1/2657 |
| 9,052,071 | B2 * | 6/2015 | Hsu | F21K 9/61 |
| 9,534,773 | B1 * | 1/2017 | Turudic | F21V 23/005 |
| 10,006,608 | B2 * | 6/2018 | Bukkems | H05K 1/0209 |
| 2012/0182711 | A1 | 7/2012 | Kolodin et al. | |
| 2013/0258657 | A1 * | 10/2013 | Lin | F21V 5/048 362/235 |
| 2013/0285545 | A1 * | 10/2013 | Shah | F21V 29/74 315/50 |
| 2014/0085881 | A1 | 3/2014 | Clifford | |

FOREIGN PATENT DOCUMENTS

| | | | |
|---|---|---|---|
| JP | 2002157914 | A | 5/2002 |
| WO | WO 2014/056999 | A1 | 4/2014 |
| WO | WO 2014/087357 | A1 | 6/2014 |
| WO | WO 2014/087363 | A1 | 6/2014 |
| WO | WO 2014/184008 | A1 | 11/2014 |

OTHER PUBLICATIONS

Search Report dated Jan. 27, 2016, in German priority application DE 10 2015 208 569.4 (8 pages).

* cited by examiner

LUMINOUS MEANS HAVING LEDS

CROSS-REFERENCE TO RELATED APPLICATIONS

This application is the U.S. national phase entry under 35 U.S.C. § 371 of International Application No. PCT/EP2016/054361, filed on Mar. 2, 2016, which claims priority to German Patent Application No. 10 2015 208 569.4, filed on May 8, 2015, the entireties of which are incorporated by reference herein.

TECHNICAL FIELD

The present invention relates to a luminous means having LEDs mounted on a circuit board, wherein the circuit board having the LEDs is arranged in an outer bulb.

Prior Art

A conventional luminous means such as, for example, a filament bulb emits light with approximately omnidirectional light distribution, thus, in simple terms, the same amount of light is emitted in all directions (except for shading by the base of the filament bulb, for example). An LED, on the other hand, emits light directionally, namely generally with Lambertian light distribution. The light intensity, or radiant intensity, is thus maximum, for example, along a surface normal to a radiating surface of the LED and decreases as the angle relative to the surface normal increases.

In order ultimately to generate homogeneous light distribution despite this directional light emission for each LED, there are known from the prior art, for example, luminous means in which a plurality of LEDs are mounted on a three-dimensional carrier, for example on five side surfaces of a cuboid. The side surfaces, and thus the main beam directions of the LEDs arranged thereon, point in different directions, so that approximately omnidirectional light distribution can be generated overall. However, the mere production, let alone the three-dimensional equipping, of such a three-dimensional carrier can be complex and thus cost-intensive.

Presentation of the Invention

The technical problem underlying the present invention is to provide a luminous means that is advantageous over the prior art.

This object is achieved according to the invention with a luminous means having a first LED and a second LED for emitting light, a flat circuit board on which the LEDs are mounted and thereby electrically conductively connected to a conductive track structure of the circuit board, an outer bulb which is transmissive for the light emitted by the LEDs and in which the circuit board having the LEDs is arranged, and a base with which the LEDs are electrically operably connected via the conductive track structure, wherein the first LED is mounted on a first side of the circuit board and the second LED is mounted on a second side of the circuit board that is opposite the first side in relation to a thickness direction, wherein all the LEDs mounted on the circuit board are arranged on one of the two circuit board sides, and wherein, in order to homogenize the light distribution generated by the luminous means, a first diverging lens is mounted on the first side of the circuit board in association with the first LED and a second diverging lens is mounted on the second side of the circuit board in association with the second LED, and the light emitted by the respective LED has a widened light intensity distribution downstream of the respective diverging lens in comparison with upstream of the respective diverging lens.

Preferred embodiments will be found in the dependent claims and in the disclosure as a whole, a specific distinction not always being made in the presentation between device aspects and method or use aspects; in any case, the disclosure is implicitly to be read in respect of all claim categories.

In simple terms, a basic idea of the invention is to create, by equipping both sides of the circuit board with LEDs, a relative arrangement of the LEDs with which, as a result of the arrangement, only two substantially mutually opposite main directions are originally predominantly provided with LED light. Thus, in contrast to the prior art mentioned at the beginning, not every main direction that is required in respect of approximate omnidirectionality has its own associated LED; instead, the light emitted is partially redistributed by means of the diverging lenses.

For example, in comparison with the cuboid mentioned at the beginning, it is thus not necessary to equip five side surfaces with LEDs but only two, namely the mutually opposite side surfaces of the circuit board. This in itself is already a simpler component, and in addition it can also be simpler, for example, to equip only two sides with LEDs than to equip a three-dimensional carrier.

An alternative approach would have been, for example, to provide a circuit board equipped with an LED on only one side and to redistribute the light emitted predominantly in a single main direction by means of only a single lens. However, figuratively speaking, this lens would then have had to redistribute significantly more light to a significantly greater degree, which would have required a correspondingly large and thus heavy lens. By contrast, the present approach, that is to say combining the arrangement-dependent "basic provision" of two opposite main directions with at least two diverging lenses, can permit, for example, the use of diverging lenses which are smaller and possibly also of simpler construction. The luminous means as a whole can be optimized in terms of weight and thus have advantages, for example, as regards handling or transport/storage costs.

The LED(s) mounted on the first side of the circuit board ("circuit board side"), thus in the case of a plurality all the LEDs mounted thereon, emits or emits the light together in the averaged "first main direction". The light from the second LED and optionally (a) further LED(s) mounted on the second circuit board side is emitted in the "second main direction". The respective main direction is obtained as the average of all the direction vectors along which light is emitted from the respective circuit board side, each direction vector being weighted in this averaging with the light intensity associated therewith (each direction in which a light source radiates can be described as a vector, with which a light intensity can be associated).

The first and the second main direction are substantially mutually opposite, thus they enclose an angle with one another, with increasing preference in this order, of at least 150°, 160°, 170° or 175° (the smaller of two enclosed angles is considered). Particularly preferably they are exactly mutually opposite, thus the angle is 180°.

The "LED main propagation direction" denotes a direction analogous to the above direction formed as the average of the direction vectors weighted with the light intensity, along which a respective LED, considered individually, emits light. If only exactly one (the first or the second) LED is arranged on a respective circuit board side, the LED main propagation direction and the respective main direction coincide. If a plurality of LEDs is arranged on a respective circuit board side, the LED main propagation direction of each of the LEDs is tilted relative to the respective main direction (of this circuit board side) by preferably at most 15°, 10° or 5° (with increasing preference in the order given), particularly preferably it coincides therewith.

Preferably, all the LEDs are so mounted on the circuit board that their respective LED main propagation direction coincides with one of two exactly mutually opposite main directions. A circuit board of comparatively simple construction can thus be used, which thus does not have any topography, for example, for positioning the LEDs in an inclined position. Equipping is also simplified.

The "flat" circuit board has a smaller extent (thickness) in its thickness direction than in the surface directions perpendicular thereto. In each of the surface directions, which also include the length and width of the circuit board (see below), the extent of the circuit board should be, for example, at least 5, 10, 15 or 20 times the thickness, a thickness averaged over the circuit board being considered. The "mutually opposite sides" of the circuit board are mutually opposite in relation to the thickness direction and are also referred to as "side surfaces" of the circuit board (which are connected together via one or more edge surfaces of the circuit board extending in the thickness direction). The LEDs are mounted on the side surfaces extending in the surface directions (no LEDs are provided on the edge surfaces, thus they are free of LEDs).

Merely with the circuit board equipped with LEDs on both sides, the surface directions remained underprovided. Therefore, in order to redistribute some of the light, at least one diverging lens is provided for each circuit board side; preference is given in each case to at most three or two diverging lenses, particular preference is given to exactly one diverging lens for each circuit board side, also in view of a structure that is as simple and inexpensive as possible.

A "diverging lens" widens the light intensity distribution by means of geometrical optics (refraction and/or reflection). In general, a plurality of LEDs may also be associated with a diverging lens, preferably exactly one is associated in each case. The opening angle (for the definition, see below) of a beam emitted by the respective LED(s) should be at least 20%, preferably at least 30%, particularly preferably at least 35%, larger immediately downstream of the respective diverging lens than immediately upstream thereof. Possible upper limits are, for example, at most 45% or 40%. The opening angle of a respective beam can be widened by means of the respective diverging lens by, for example, at least 20°, preferably at least 40°, further preferably at least 55°, possible upper limits (independently thereof) being, for example, at most 175% or 170%.

Should a respective beam be widened differently in the axes perpendicular to its main propagation direction (formed with a weighting according to the light intensity), an average is considered. Preferably, however, the widening should be substantially equal, thus it should differ in two axes perpendicular to one another and to the main propagation direction by at most 30%, preferably at most 15%, particularly preferably at most 5% (based on the greater widening), which preferably applies to all such pairs of mutually perpendicular axes.

The determination of the opening angle of the respective beam immediately upstream of the respective diverging lens is based on the full width at half maximum. The opening angle downstream of the diverging lens is taken where the light intensity has fallen to half the value which the beam has on an axis on which the maximum lies immediately upstream of the diverging lens. If the position of the maximum remains unchanged, the full width at half maximum is thus also taken as the basis downstream of the diverging lens.

A respective diverging lens is "associated" with the respective LED(s) in such a manner that, for example, at least 60%, 70%, 80% or 90%, with increasing preference in that order, of the light emitted by the respective LED(s) passes through the diverging lens. With regard to the efficiency, as large a proportion as possible can be preferred; for technical reasons (reflection/absorption), upper limits may be, for example, 99%, 97% or 95%.

The LEDs "mounted" on the circuit board are preferably soldered, at least some of the soldered connections at the same time establishing the electrical contact between the conductive track structure and the LED and serving to mechanically fix the LED (however, soldered connections that serve only for mechanical fixing/thermal connection can additionally be provided). Preferred LEDs are so-called SMD (surface mounted device) components, which are soldered in a reflow process. The luminous means can be electrically connected (from outside in use) via the base.

The LEDs are "electrically operably" connected to the base, that is to say to the connecting points thereof that serve for contacting from outside, preferably with the interposition of a driver electronics (between the connecting points of the base and the LEDs). The luminous means is preferably configured for operation at mains voltage (at least 100 volts), thus mains voltage can be applied to the base connecting points and is preferably adapted for operation of the LEDs by means of a driver electronics of the luminous means.

The luminous means is preferably designed as a filament bulb replacement; the base is preferably an Edison base, particularly preferably with the thread identifier E27. In general, the outer bulb can also thus be clear (transparent), but it is preferably frosted, thus, for example (when the luminous means is not emitting light), the circuit board is visible through the outer bulb from outside at most as an outline, preferably not at all. The frosting can be achieved, for example, by scattering centers, in particular scattering particles, embedded in the material of the outer bulb, and/or by scattering centers arranged on the surface of the outer bulb, for example a surface roughening and/or surface coating. Preference is given to a coating on the inside, that is to say a coating on the inner wall surface facing the LEDs, which can provide protection against scratches, for example, in use.

The circuit board having the LEDs is so arranged in the outer bulb that the majority of the light emitted by the LEDs passes through the outer bulb, that is to say passes from inside to outside and is usable in an application. "Majority" in this respect can mean, for example, at least 70%, preferably at least 80%, further preferably at least 90%; a possible upper limit may be, for example, at most 99.9%. The light emitted by the LEDs can be incident on the inner wall of the outer bulb and pass through it to the outside directly and/or after prior reflection.

In a preferred embodiment, at least one of the diverging lenses has a total reflection surface on its side remote from the respective LED. Preferably, only a part of the light incident on that surface is totally reflected, depending on the angle of incidence, and another part passes through it, thus the total reflection surface is at the same time also an exit surface. For example, at least 20%, 30%, 40% or 50%, with increasing preference in that order, of the light emitted by the LED(s) associated with the respective diverging lens is to be reflected at the total reflection surface; possible upper limits may be, for example, 90%, 80% or 70%.

The total reflection surface is thus at the same time also an exit surface; a part of the light (which is incident thereon at a small angle of incidence) exits the diverging lens at the total reflection surface and another part (at an angle of incidence $>\theta_c$) is totally reflected. The totally reflected light is reflected away from the LED main propagation direction of the respective LED, thus each of the rays of a totally reflected beam encloses a larger angle with the LED main propagation direction downstream of the total reflection surface than it does upstream of the total reflection surface.

The total reflection surface is preferably at least radially symmetrical, particularly preferably rotationally symmetrical. Preferably, a corresponding axis of radial/rotational symmetry passes through a centroid of an area of the light emitting surface(s) of the LED(s) associated with the diverging lens. The reflection surface tapers towards the respective LED(s), thus has a decreasing diameter in that direction. It corresponds particularly preferably to the lateral surface of a cone, or corresponding truncated cone, with its tip pointing towards the respective LED(s).

The total reflection surface preferably merges at a peripheral edge into a lateral light exit surface of the diverging lens. The preferred form for the lateral light exit surface is a cylinder lateral surface, the axis of rotation of which further preferably coincides with the axis of rotation of the total reflection surface. In the interests of as simple a construction as possible, a planar light entry surface can be preferred, to which the axes of rotation of the total reflection, or light exit, surface are perpendicular.

In general, the diverging lens is preferably made from a plastics material, which can also have advantages regarding the weight, for example. The plastics material can be polycarbonate, polymethyl methacrylate or silicone, for example. In general, however, glass would also be conceivable. The refractive index of the lens material can generally be, for example, at least 1.3, preferably at least 1.4, and (independently thereof), for example, at most 1.8, 1.7 or 1.6 (in each case taken at a wavelength of 589 nm).

In a preferred embodiment, a light exit surface of the diverging lens is curved. At the curved light exit surface, at least a part of the light emitted by the respective LED, for example at least 20%, with increasing preference in this order at least 30%, 40% or 50%, is refracted away from the respective LED main propagation direction; possible upper limits are, for example, at most 95% or 90%. The light rays of a correspondingly refracted beam in each case enclose a smaller angle with the LED main propagation direction upstream of the curved light exit surface than they do downstream thereof.

In general, the diverging lens can also distribute the light away from the LED main propagation direction by a combination of reflection and refraction. However, one of the two alternatives can be preferred, thus, for example, a diverging lens that redistributes the light solely by refraction. In general, the light exit surface that refracts the light away from the main direction is preferably convexly curved.

The diverging lens can generally also be provided in direct optical contact with the respective LED(s). The diverging lens can thus, for example, be formed directly on the LED or connected thereto by an intermediate material (with, for example, a refractive index $n_{zw} \geq 1.2$ or $\geq 1.3$). The intermediate material is preferably an adhesive, which at the same time can serve to mechanically fix the diverging lens. The refractive index of the intermediate material is preferably between that of the lens material and that of a potting material covering the LED chip (again considered at 589 nm).

In a preferred embodiment, however, the light entry surface of a respective diverging lens is separated from the respective LED by a gas volume. The gas can correspond, for example, to the gas in the outer bulb, thus can be, for example, a separate filling gas or also air (see below in detail). The light entry surface is preferably concavely curved.

In the case of a diverging lens with a convexly curved light exit surface, the concavely curved light entry surface preferably has a greater curvature than the light exit surface.

Preferably, a respective diverging lens has an optical axis and is so arranged on the circuit board that an optical axis direction parallel to the optical axis and pointing away from the circuit board towards the respective diverging lens encloses an angle of, with increasing preference in this order, at most 20°, 15°, 10° or 5° with the main direction of the LED(s) of the corresponding circuit board side; particularly preferably, the optical axis direction and the respective main direction coincide. The diverging lens is preferably radially symmetrical, particularly preferably rotationally symmetrical, about its optical axis, at least in the region thereof through which light passes, thus, for example, apart from mounting elements (pins/holes, see below).

In a preferred embodiment, the first and the second diverging lens each has an optical axis, and these optical axes coincide. If a further diverging lens is provided on each circuit board side, the optical axes of the further diverging lenses preferably also coincide. A correspondingly symmetrical structure can be advantageous, for example in view of as even a luminous density distribution as possible on the outer bulb.

In a preferred embodiment, the first and the second diverging lens are connected together by a pin which passes through a through-hole in the circuit board and engages in at least one of the two diverging lenses, thus is inserted into a hole in the at least one diverging lens. In general, a pin that is previously separate from both diverging lenses could also be provided and accordingly inserted into both diverging lenses. However, the pin preferably engages only in exactly one of the diverging lenses and is formed monolithically with the other of the two, for example produced together therewith in the same injection molding step. A "monolithic" part is free in its interior of material boundaries between different materials or materials of different manufacturing origins, apart from randomly distributed inclusions.

In general, the two diverging lenses are preferably assembled by at least two, further preferably at least three, pins, each of which preferably passes through its own through-hole in the circuit board. Preferably at most six or five pins are provided for the two diverging lenses, particularly preferably there are exactly four.

A respective pin can also be adhesively bonded, for example, in the diverging lens(es) in which it engages. The pin/hole interlocking connection can then block relative displaceability in relation to the surface directions of the circuit board, and the adhesive bond can hold the two diverging lenses together in relation to the thickness direction. In general, however, a friction-based connection alone, for example, can also hold the pin in the respective hole/holes. The pin can, for example, taper towards its free end and then be pressed into the hole to a certain extent in order to be seated therein.

In a preferred embodiment, the first and the second diverging lenses are structurally identical. The lenses can thus be formed, for example, with the same injection molding tool, which can help to optimize costs. Each of the diverging lenses then preferably has both a pin and a hole. The arrangement thereof is then such that the diverging lenses are rotated relative to one another to a certain extent when they are fitted together, for example rotated through 90° in the case of a total of four pins (see FIGS. 5 and 6 for illustration).

If a plurality of diverging lenses are provided for each circuit board side, they can preferably be formed monolithically with one another, for example as an injection molded part. This can simplify handling and also help to reduce mounting/alignment errors, for example. These lens parts each comprising a plurality of diverging lenses are then preferably structurally identical overall (the lens parts arranged on opposite circuit board sides).

In a preferred embodiment, the circuit board having the LEDs is so arranged in the outer bulb that the LED main propagation directions enclose an angle of at least 80°, preferably at least 85°, and at most 100°, preferably at most 95°, with a longitudinal direction parallel to the outer bulb longitudinal axis and pointing away from the base towards the outer bulb; particularly preferably, the LED main propagation directions are in each case perpendicular to the outer bulb longitudinal direction. The outer bulb longitudinal axis passes through the base; preferably, the outer bulb is radially symmetrical, particularly preferably rotationally symmetrical, about the longitudinal axis. All the LEDs mounted on the circuit board should be arranged with their respective LED main propagation direction corresponding to the outer bulb longitudinal direction, preferably all the LEDs of the luminous means overall. In general, preferably all the LEDs of the luminous means are mounted on the circuit board.

In a preferred embodiment, the light distribution of the luminous means is so homogenized that the light intensity measured on a circular path around the outer bulb longitudinal axis (at an elevation angle of 90°, that is to say perpendicular to the outer bulb longitudinal direction) exhibits at most a slight variation. Any light intensity value taken on this circular path should thus represent at least 30%, preferably at least 25%, of a maximum value of the light intensity taken on the circular path. Preferably, the light intensity also exhibits a correspondingly small variation at other (but always constant, for each circular path) elevation angles.

Preferably, in all directions which enclose an angle of between 0° and a critical angle with the outer bulb longitudinal direction (see above), a light intensity other than zero is still measured, which preferably represents at least 10%, further preferably at least 20% or 30% of a maximum light intensity. The critical angle is, with increasing preference, greater than 90°, 100°, 110°, 120°, 130°, 140°, 150° or 160°; at angles greater than 170°, the light intensity can be zero.

In a preferred embodiment, the circuit board is composed of a substrate, for example FR4, the mutually opposite sides of which are provided with structured conductive track material, preferably copper, which forms the conductive track structure. The substrate is flat and preferably planar, thus the mutually opposite side surfaces of the substrate each lie in a plane, which planes are parallel to one another (and spaced apart from one another by the substrate thickness). Preference is given to a non-electrically conductive substrate, to which the conductive tracks are further preferably applied directly.

In a preferred embodiment, the circuit board can be composed of a plurality of substrate layers, that is to say at least two and preferably at most four or three, particularly preferably exactly two substrate layers. The preferably two substrate layers are preferably each provided on one side with conductive tracks, thus one side surface of each substrate layer is free of conductive tracks; the substrate layers are then further preferably assembled with their LED-free side surfaces facing one another, so that the outer side surfaces of the resulting multilayer substrate are then provided with the conductive tracks. The substrate layers are integral with one another so that they cannot be separated from one another without damaging one of them or a part connecting them, in particular a connecting layer. In general, they can also simply be in contact with one another, they are preferably connected together by a material-based joint connecting layer, particularly preferably an adhesive layer. They can, for example, also be held together by assembled diverging lenses (see above).

The substrate layers can be made, for example, from the above-mentioned FR4, thus the circuit board can be assembled, for example, from two circuit board parts each provided on one side with conductive tracks. The conductive tracks of the two circuit board parts can then be electrically conductively connected to one another, for example, by means of a clamp as connector. The substrate layers are preferably made from a polyester material, polyethylene terephthalate (PET) is particularly preferred. The substrate layers can, for example, each have a thickness of at least 150 μm, 200 μm or 250 μm and (independently thereof) of, for example, at most 500 μm, 450 μm, 400 μm or 350 μm, in each case with increasing preference in the order given (the thickness is generally considered to be an average, it is preferably constant).

It can be preferred that the substrate layers are/have been formed from a substrate sheet which is/has been laid back on itself; the substrate sheet is preferably folded back on itself about a fold line. The substrate sheet is preferably laid or folded back with the LEDs already mounted thereon, which allows one-sided equipping (of the substrate sheet) while nevertheless resulting in a multilayer substrate equipped on both sides. Such an advantage can moreover also arise if, as described above, two circuit board parts each provided with conductive tracks on one side are assembled and are already each equipped with LEDs when assembled.

In a preferred embodiment, which can also be of interest independently of a concretization of the substrate sheet thickness, the conductive tracks of the conductive track structure have a thickness of at least 20 μm, preferably at least 25 μm, further preferably at least 30 μm, particularly preferably at least 35 μm. Advantageous upper limits may be, for example, at most 100 μm, preferably at most 90 μm, further preferably at most 80 μm, particularly preferably at most 70 μm, whereby the upper and lower limits can again also be of interest independently of one another. The conductive track structure and the multilayer substrate are integral with one another, thus cannot be separated from one another without causing damage (without damaging part of the assembly).

In a preferred embodiment, a heat sink is provided in direct thermal contact with the circuit board, which heat sink either itself forms an outer surface of the luminous means or is provided in direct thermal contact with part of the luminous means, preferably a housing part (see below) separate from the base, which forms an outer surface of the luminous means. The thermal resistance $R_{th}$ of the heat sink is dependent, for example, on the thermal conductivity of the heat sink material and on the connection thereof, but should be at most 25 K/W, whereby at most 20 K/W, 15 K/W, 10 K/W or 5 K/W are further upper limits of increasing preference in the order given. A thermal contact resistance between the circuit board and the heat sink should preferably be small, that is to say, for example, should represent at most 50%, 40%, 30%, 20% or 10% of the thermal resistance $R_{th}$ of the heat sink; the same is true for any thermal contact resistance to the part forming the outer surface of the lighting element (provided this does not itself form the outer surface).

The material of the heat sink is preferably a metal, for example aluminum, but it is also possible to provide, for example, a thermally conductive plastics material, that is to say, for example, a plastics material with particles embedded therein to increase the thermal conductivity.

"In direct thermal contact" means with at most a material-based connecting layer there between, for example a solder layer, preferably directly in contact with one another. Preferably, the heat sink is in contact (to the outside, for heat dissipation) with a housing part arranged between the base and the outer bulb, wherein the housing part and the heat sink are further preferably held together by an interference fit (press fit), that is to say the heat sink is pressed into the housing part. If a heat sink is provided, the outer bulb can be made of a plastics material, which can have cost advantages. The outer bulb also does not have to provide, for example, a closed gas volume (containing thermally conductive gas), which can help to reduce the outlay.

Thus, although the outer bulb does not have to hermetically seal the volume with the circuit board by itself and also together with the base and/or a housing part, it can at least be closed off to such an extent that the penetration of dust can be prevented. The thermal concept thus makes it unnecessary to provide, for example, ventilation slots and the like, which could otherwise allow the ingress of dirt. The outer bulb itself is preferably free of slots (connecting the inner and outer volumes).

In a preferred embodiment, the circuit board and the heat sink are in direct contact with one another and they have a contact surface with one another whose surface area is at least as large as a surface area of the two side surfaces of the circuit board that is equipped with LEDs. The base areas of the LEDs arranged on the circuit board are thus added together, and the contact surface between the heat sink and the circuit board should correspond at least to that total area. The contact surface is preferably divided into a plurality of part surfaces (which are each formed, for example, by a tongue, see below) which are spaced apart from one another, the part surfaces then further preferably being distributed equally over the side surfaces of the circuit board. The "base area" of an LED is taken at a perpendicular projection of the LED into a plane perpendicular to the thickness direction of the circuit board.

The contact surface which the circuit board and the heat sink have with one another should represent, for example, with increasing preference in this order, at least 4 $mm^2$, 8 $mm^2$, 12 $mm^2$, 16 $mm^2$ or 20 $mm^2$. Possible upper limits (independently of the lower limits) are, for example, at most 80 $mm^2$ or 60 $mm^2$.

In a preferred embodiment, the heat sink is in contact with the mutually opposite side surfaces of the circuit board in each case directly with a tongue, preferably in each case with at least two tongues, further preferably in each case exactly two tongues. The circuit board is held by a friction-based connection between the tongues, which each form a part surface of the contact surface; a certain force is thus required in order to move the circuit board along the outer bulb longitudinal axis, the circuit board can be prevented by a friction-based connection, for example, at least from slipping out under the action of gravity (in the case of an outer bulb longitudinal axis that is parallel to the direction of gravity).

For each tongue, the particular part surface of the contact surface can have a surface area of, for example, with increasing preference in this order, at least 2 $mm^2$, 3 $mm^2$, 4 $mm^2$, 5 $mm^2$, 6 $mm^2$, 7 $mm^2$, 8 $mm^2$ or 9 $mm^2$. Possible upper limits (independently of the lower limits) may be, for example, at most 20 $mm^2$ or 15 $mm^2$.

For each tongue, it is preferred that a pressing region of the tongue forming the contact surface is closer to the LEDs than a deformation region of the tongue, the resilient deformation of which at least determines the majority of the pressing force. The tongue thus extends with the pressing region towards the LEDs and accordingly away from the base in the luminous means. The respective part surface (of the contact surface) can thus be arranged as close as possible to the LED, which helps to improve heat dissipation. In general, it can be preferred that at least the first and second LED (preferably also the third and fourth LED) have a smallest distance from their respective associated part surface of the contact surface of at most, with increasing preference in this order, 15 mm, 10 mm or 5 mm. Possible lower limits may be, for example, at least 0.5 mm or 1 mm.

In the case of a tongue having a pressing region extending towards the LEDs, the pressing region can also be followed (going from the deformation region to the pressing region) by a reflection region which rises away from the circuit board and on which a part of the light emitted by the respective LED is incident and is reflected with a directional component along the outer bulb longitudinal axis. The proportion of the light incident thereon and being reflected thereby can be, for example, at least 5% or 10% (and, for example, at most 30% or 20%).

In a preferred embodiment, the heat sink is assembled from at least two parts, preference being given to exactly two parts, wherein the heat sink parts together enclose the circuit board, namely in relation to a circular path around the outer bulb longitudinal axis. "Assembled" means, for example, connected together at most by a friction-based, interlocking and/or material-based connection. Preferably, the heat sink parts are assembled on the circuit board in such a manner that, with the assembly of the heat sink, the heat sink is also already in position on the circuit board (as well as thus also arranged in the luminous means on the circuit board). Preferably, the heat sink parts are locked together, thus they are then held together in an interlocking manner. After assembly, the heat sink is preferably inserted, preferably pressed, into the housing part (see above), thus the heat sink is oversized relative to the housing part in order to be held therein with an interference fit.

The outer bulb is then fitted to the housing part, preferably seated in the form of a monolithic part having a movement along the outer bulb longitudinal axis. Preferably, the outer bulb is thereby pushed into the housing part to a certain extent and locked therewith.

Apart from the assembly of the heat sink parts around the circuit board, such a production method can, however, also be preferred in the case of a one-piece/monolithic heat sink. Such a heat sink can then also be held in the housing part by an interference fit, for example. In particular in the case of the monolithic heat sink (but generally also in the case of an assembled heat sink), the circuit board and the heat sink can generally also be connected together by a material-based connection, for example by a soldered or preferably welded connection.

In a preferred form of the heat sink assembled from heat sink parts, the heat sink and the circuit board are connected together in an interlocking manner, whereby the interlocking connection is intended to block a relative movement of the circuit board and the heat sink parallel to the outer bulb longitudinal axis. For that purpose there is preferably provided in the circuit board a groove which extends between the mutually opposite side surfaces thereof, preferably at an edge surface of the circuit board extending parallel to the outer bulb longitudinal axis, the edge surface is set back in the groove relative to the remainder of the edge surface. The assembled heat sink then engages into the groove and in this respect holds the circuit board in position.

In a preferred embodiment, the outer bulb and the housing part arranged between the base and the outer bulb adjoin one another at a circumferential (around the outer bulb longitudinal axis) line and the heat sink shades this boundary line from the LEDs, which prevents a direct light input, thus light falls from the LEDs onto the line without reflection. This can be perceived as more aesthetically pleasing when the luminous means is viewed from outside. Of course, the outer bulb and the housing part can also adjoin one another circumferentially at a surface; the "boundary line", when looking at the luminous means from outside, is considered to be the transition, visible at the outer surface of the luminous means, between the housing part and the outer bulb.

A housing part arranged between the base and the outer bulb and assembled (see the above disclosure relating to this term) with both is generally preferred, it being possible for the housing part, based on a total length of the luminous means taken along the outer bulb longitudinal axis (from the base end to the opposite outer bulb end), to extend over, for example, at least 10%, preferably at least 20%, of that total length; possible upper limits are, for example, at most 40% or 30%.

The luminous means can, however, generally also be designed without such a housing part, the outer bulb and the base then being assembled directly, that is to say adjoining one another (as in a conventional filament bulb). The driver electronics can then be accommodated in the base, for example. In order to be able to recreate a filament bulb shape with an outer bulb tapering towards the base, the outer bulb is in this case preferably assembled from two half-shells, which further preferably adjoin one another in a plane containing the outer bulb longitudinal axis.

Independently of this configuration (with/without a housing part) and the outer bulb specifically, the driver electronics for supplying the LEDs is in a preferred embodiment arranged with the LEDs on the same circuit board. Preferably, the luminous means has only a single circuit board, which already has cost advantages and can also help to reduce the outlay in terms of mounting. Because the luminous means is provided with a heat sink, it is not necessary, for example, for cooling purposes to evacuate the outer bulb and fill it with thermally conductive gas, but the outer bulb can instead be filled with air. Housed electronic components (driver electronics) can then be arranged in the same air volume, which would be disadvantageous in the case of a thermally conductive gas, for example due to outgassing of the molding compound.

In another preferred embodiment, a glass outer bulb is provided, and this glass outer bulb delimits a closed volume. The closed volume is preferably filled with a filling gas which has a higher thermal conductivity compared to air (the gas mixture of the earth's atmosphere at sea level). The filling gas can contain helium, for example, namely in a greater proportion than air, for example in a proportion of, with increasing preference in this order, at least 50 vol. %, 70 vol. %, 99 vol. %. The helium in the filling gas can be mixed, for example, with air and/or nitrogen and/or oxygen.

In a preferred embodiment, the circuit board having the LEDs is then arranged wholly within the filling gas volume delimited by the glass outer bulb, thus it does not extend through the outer bulb wall. Further preferably, it is also spaced apart from an inner wall surface of the outer bulb delimiting the filling gas volume, thus it is not in contact therewith.

In a further form of the circuit board arranged wholly within the filling gas volume, the circuit board is free of a driver electronics, thus preferably only the LEDs are arranged on the circuit board and are electrically conductively connected to the conductive track structure. The driver electronics nevertheless preferably integrated into the luminous means is then arranged, for example, in the base, for example on a second circuit board. By not providing a driver electronics within the filling gas volume (the filling gas volume is free thereof), it is possible to prevent, for example, contamination of the filling gas, which could damage the LEDs, for example. When designing the driver electronics, it is then not necessary to give separate consideration to whether, for example, components of the housing technology (for example the potting compound) outgas; thus expensive special components do not have to be used, which can help to optimize costs in particular in respect of mass production.

In general, the circuit board preferably has a width, taken in one of the surface directions, of at most 30 mm, with at most 25 mm being further preferred and at most 20 mm being particularly preferred. Possible lower limits may be, for example, at least 15 mm or 18 mm. In a surface direction perpendicular to the above-mentioned surface direction, the circuit board preferably has a length of at most 60 mm, with at most 55 mm being further preferred and at most 50 mm being particularly preferred. In the luminous means, the circuit board is preferably so oriented that its width is taken perpendicularly to the outer bulb longitudinal axis. The longitudinal extent of the circuit board is then parallel to the outer bulb longitudinal axis.

The mentioned upper limits are to be understood as meaning that the circuit board, in particular in the case of the width, has a width over its entire length that is smaller than/equal to the upper limit. This preferably applies analogously to the lower limit and/or correspondingly to the upper/lower limit of the length. Although as large a circuit board as possible may generally be preferred for thermal reasons, for example, it can be advantageous to limit the width of the circuit board because the luminous means can thus be produced using manufacturing steps of a conventional filament bulb.

It is possible, for example, comparably to the manufacture of filament bulbs, to provide a glass bulb which tapers to an opening—instead of a lamp base with a glow filament there is then used, for example, a lamp base with a circuit board. The circuit board, which is limited in width, can thereby be introduced through the opening of reduced diameter (reduced owing to the taper). From the production point of view, compatibility with existing process steps or intermediate products is thus achieved.

The preferably frosted outer bulb is preferably coated on the inside for frosting (see above), further preferably with a scratch-resistant coating. In relation to the handling of the finished luminous means by a user, although the frosting coating is already protected by being arranged on the inner surface of the outer bulb wall; however, the provision of a scratch-resistant coating can advantageously prevent the coating from being damaged during assembly of the luminous means.

In the production context, "glass bulb" in the present case refers to a preliminary stage of the outer bulb which is characterized by the opening on one side, to which the glass bulb tapers. By closing the opening of the glass bulb, the outer bulb delimiting a closed volume is produced, the tapering, that is to say pear-shaped, form preferably remaining unchanged.

The glass bulb opening does not necessarily have to be closed in a single step. Preferably, the circuit board is held in a lamp base made of glass, which is placed at the opening and fused with the glass bulb. The lamp base thereby closes the opening, but preferably not yet completely; instead, it still provides a channel through which the inner volume of the glass bulb is accessible to compressed fluid. The filling gas is introduced into the inner volume of the glass bulb via the channel, and then the channel is closed, preferably by fusion of glass. Before the filling gas is introduced, the inner volume of the glass bulb is preferably at least partially evacuated via the channel.

Current leads, for example of wire, which are electrically conductively connected to the circuit board, preferably already pass through the lamp base of glass when it is positioned at the opening of the glass bulb, via which current leads the LEDs are thus electrically operable/contactable. After the lamp base has been fixed in place, and preferably also after the glass bulb has been closed, the base is then electrically conductively connected to the current leads and fitted to the outer bulb, for example connected thereto by a material-based connection, for example adhesively bonded.

BRIEF DESCRIPTION OF THE DRAWINGS

The invention will be explained in greater detail below by means of exemplary embodiments, wherein the individual features within the scope of the further independent claims can also be fundamental to the invention in a different combination and, as before, a specific distinction is not made between the different claim categories.

The drawings specifically show

PREFERRED EMBODIMENT OF THE INVENTION

Figure 1:
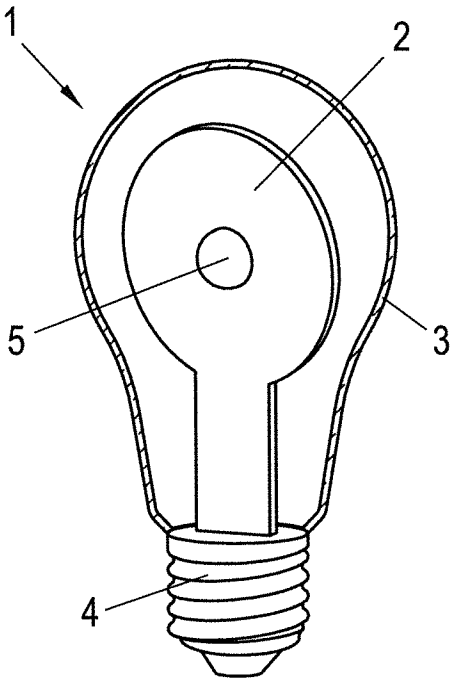
FIG. 1 a first luminous means according to the invention in an oblique view.

FIG. 1 shows a first luminous means 1 according to the invention, namely a circuit board 2 equipped with LEDs, which is arranged in an outer bulb 3 and electrically conductively connected to a base 4 (not shown in detail). The base 4 is an E27 screw base, the luminous means 1 is thus designed as a replacement for a filament bulb. According to the invention, the circuit board 2 is equipped with LED(s) on both sides, and the LED light is in each case widened by a diverging lens 5.

Figure 2:
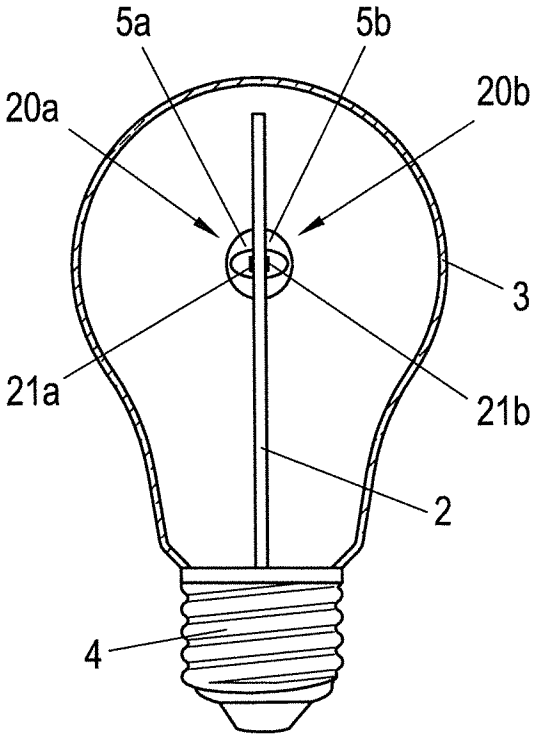
FIG. 2 the luminous means according to FIG. 1 in a partially cutaway side view.

The partially cutaway side view according to FIG. 2 illustrates the structure in greater detail, an LED 21*a, b* is mounted on each side 20*a, b* of the circuit board 2 and electrically conductively connected with a conductive track structure of the circuit board 2 (not shown in detail). A respective diverging lens 5*a, b* is further associated with each of the LEDs 21*a, b* so that the LED light is incident on a respective light entry surface 31*a, b* of the respective diverging lens 5*a, b*, passes through the lens and then exits at a respective light exit surface 32*a, b*, see the detail view according to FIG. 3.

Figure 3:
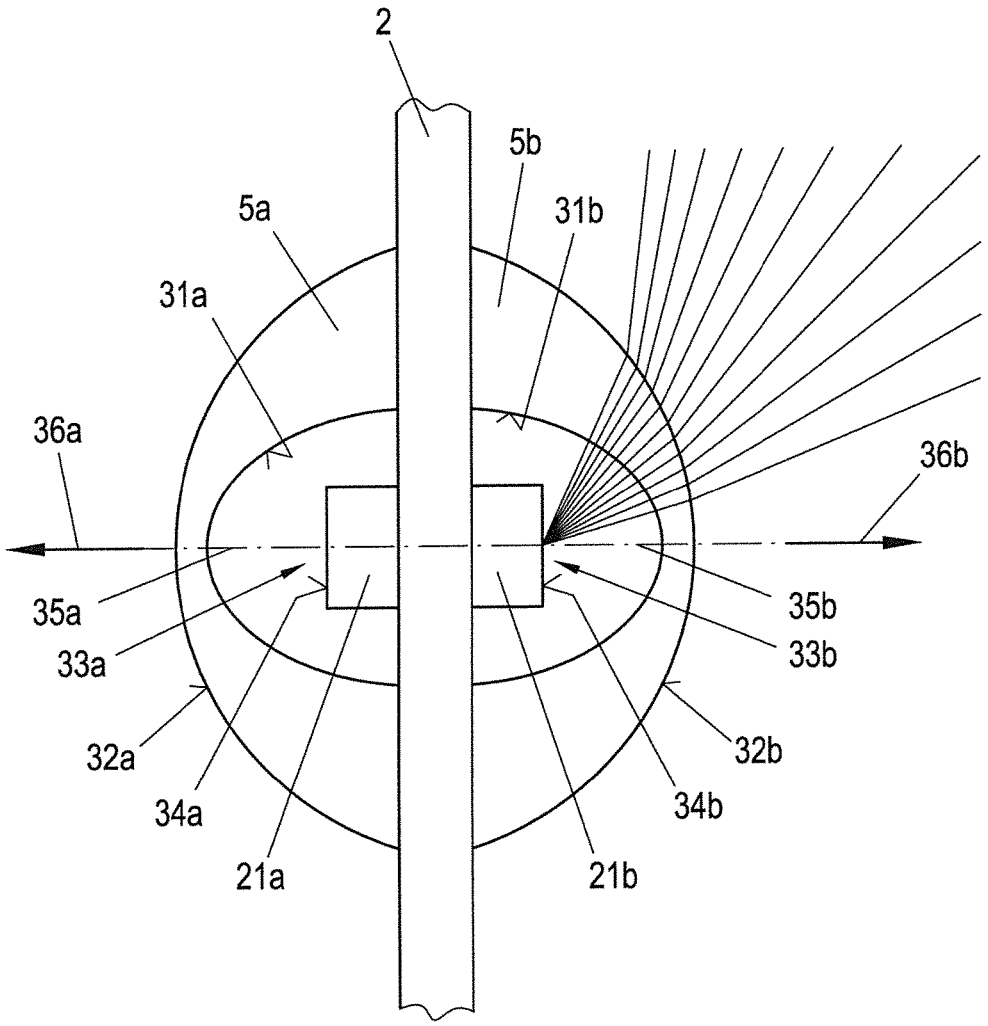
FIG. 3 a detail view of the side view according to FIG. 2, to illustrate the diverging lens function.

In the case of the right-hand LED 21*b* in FIG. 3, there is shown by way of example a beam which corresponds to a part of the whole beam (of the whole LED light). The light entry surfaces 31 are each concavely curved in such a manner that rays emitted from a centroid of an area 33*a, b* of a respective light emitting surface 34*a, b* of the respective LED 21*a, b* are approximately perpendicular to the respective light entry surface 31*a, b*, see the beam shown by way of example.

The light exit surfaces 32*a, b* are each convexly curved, the radius of curvature being greater than that of the light entry surfaces 31*a, b*. The optical path length within the diverging lens 5*a, b*, which a respective light ray thus "sees", increases as the tilting relative to a respective optical axis 35*a, b* increases. In simple terms, the diverging lenses each become thicker towards the edge. At the light exit surface 32*a, b*, the rays are then each refracted away from a respective LED main propagation direction 36*a, b*, in which the corresponding LED 21*a, b* predominantly emits the light. The light intensity distribution is thus in each case widened downstream of the diverging lens 5*a, b*.

The diverging lenses 5*a, b* are so arranged that their optical axes 35*a, b* coincide. The diverging lenses 5*a, b* each have a diameter, taken perpendicularly to their optical axis 35*a, b*, of 12.7 mm; the height taken along the optical axis 35*a, b* is in each case 4.5 mm.

Figure 4A:
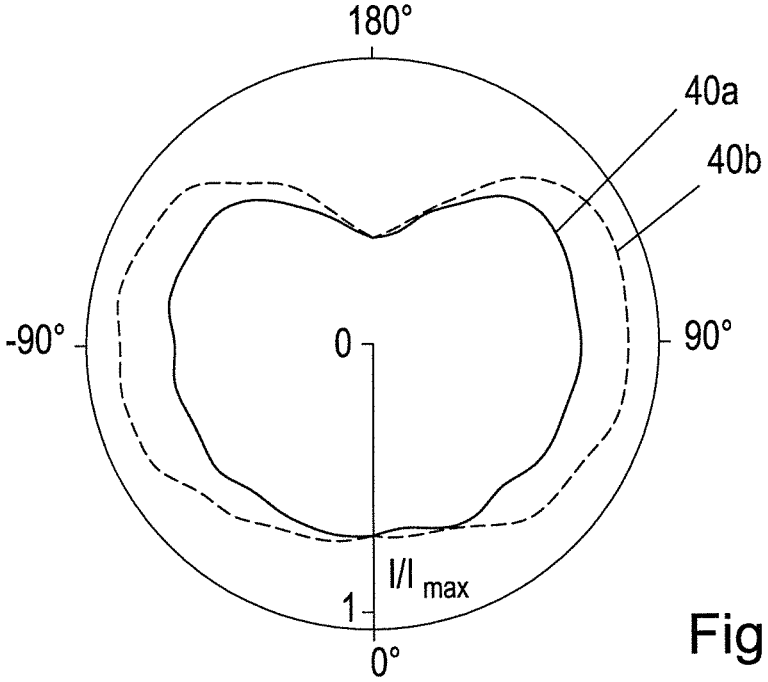
FIG. 4*a,b* light distribution curves to illustrate the effect of the diverging lens function on the light distribution.

FIGS. 4*a* and *b* show light distribution curves which illustrate the homogenization achieved with the diverging lenses. The normalized radiant intensity $I/I_{max}$ is thereby plotted in a polar diagram, the angle θ corresponding to the elevation angle θ in spherical coordinates. The base is at an angle θ of 180°, the outer bulb longitudinal axis extends away from the base through the outer bulb at an angle θ of 0°.

A first light distribution curve 40*a* is then taken at an azimuth angle at which the circuit board 2 is viewed from the side, corresponding to the view according to FIG. 2. A second light distribution curve 40*b*, by contrast, is taken at an azimuth angle at which, at an elevation angle of +/−90°, the respective circuit board side 20*a, b* is viewed from the top, thus the respective LED 21*a, b* is seen in a direction exactly opposite to the respective LED main propagation direction 36*a, b*. The light distribution curves 40*a, b* were each determined with a ray tracing simulation.

FIG. 4*a* shows two corresponding light distribution curves 40*a, b* for the luminous means 1 according to FIGS. 1 and 2. Owing to the widening of the light intensity distribution by means of the diverging lenses 5*a, b*, the dependency on the azimuth angle is comparatively low. The diverging lenses 5*a, b* distribute the light to the side, that is to say in the surface directions of the circuit board 2, see also FIG. 3.

Figure 4B:
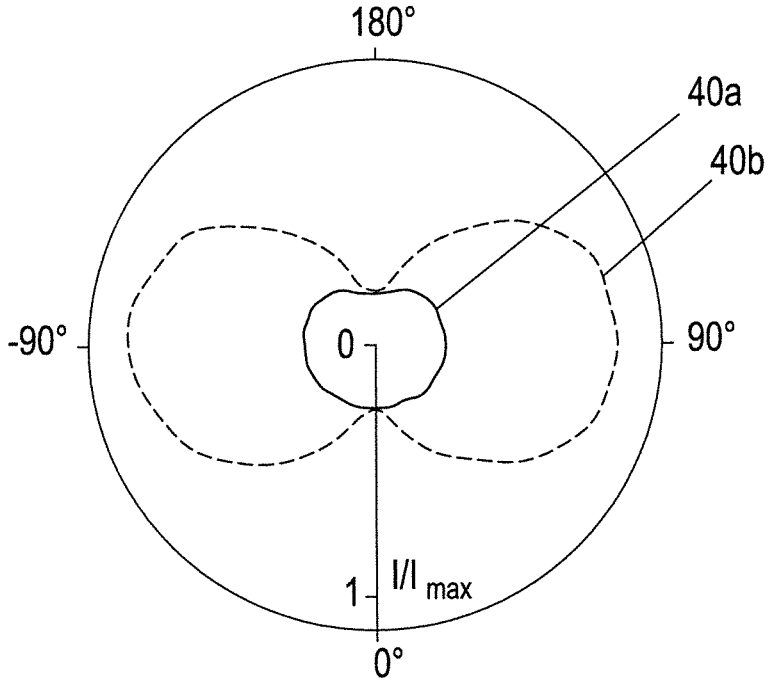

The homogenization that is achieved is illustrated in particular by a comparison with FIG. 4*b*. In the case of FIG. 4*b*, the same structure was considered without the diverging lenses 5*a, b*, and a considerable difference is obtained between the viewing direction "top view of the LEDs" (light distribution curve 40*b*) and the viewing direction "side view of the LEDs" (light distribution curve 40*a*). Apart from this homogenization with regard to the azimuth angle that is thus achieved with the structure according to the invention, the variation in relation to the angle θ is also reduced. This is shown in particular by a direct comparison of the light distribution curves 40*b* according to FIGS. 4*a* and 4*b*.

Figure 5:
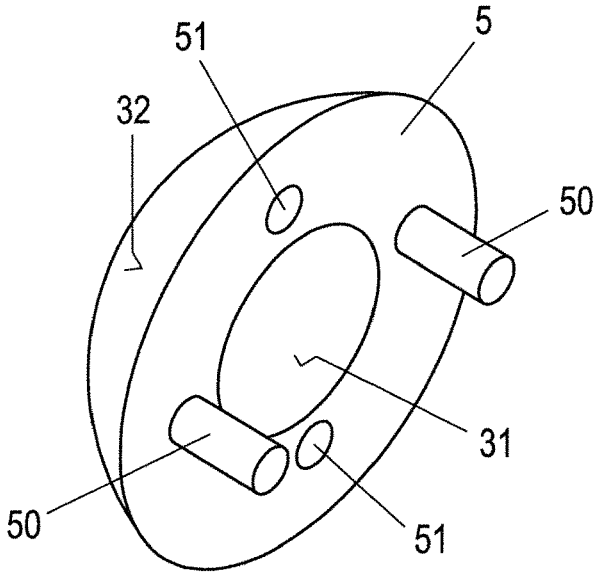
FIG. 5 a diverging lens of the luminous means according to FIGS. 1 and 2 in an oblique view from beneath.

FIG. 5 shows one of the diverging lenses 5 of the luminous means according to FIGS. 1 and 2 in an oblique view from beneath; looking at the light entry surface 31 (a part of the light exit surface 32 can nevertheless also be seen).

Two pins 50 are formed on the diverging lens 5; they are injection molded together with the diverging lens 5 and thus formed monolithically therewith. Two holes 51 are also provided in the diverging lens 5, into which holes the pins 50 of the other diverging lens 5 can then be pushed when the diverging lenses 5 are assembled.

Figure 6:
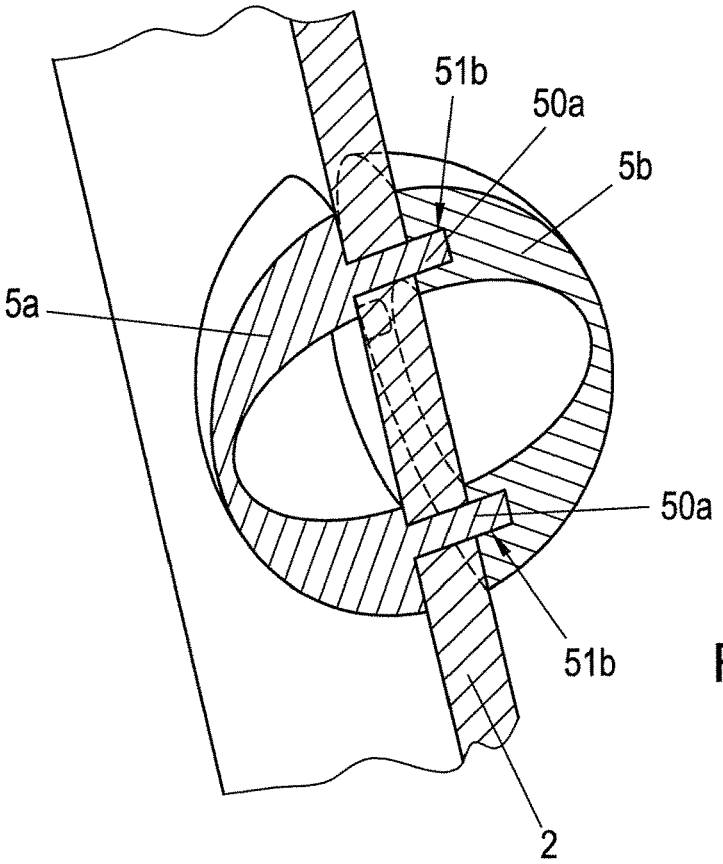
FIG. 6 the mounting of two diverging lenses according to FIG. 5 in the luminous means according to FIGS. 1 and 2.

This assembly is illustrated in detail in FIG. 6. The pins 50 (e.g., pin 50*a*) each extend through a through-hole in the circuit board 2 and engage in a respective associated hole 51 (e.g., hole 51*b*) in the respective other diverging lens 5*a, b*. The diverging lenses 5*a, b* are structurally identical and are mounted rotated by 90° relative to one another about their optical axes 35*a, b*.

Figure 7:
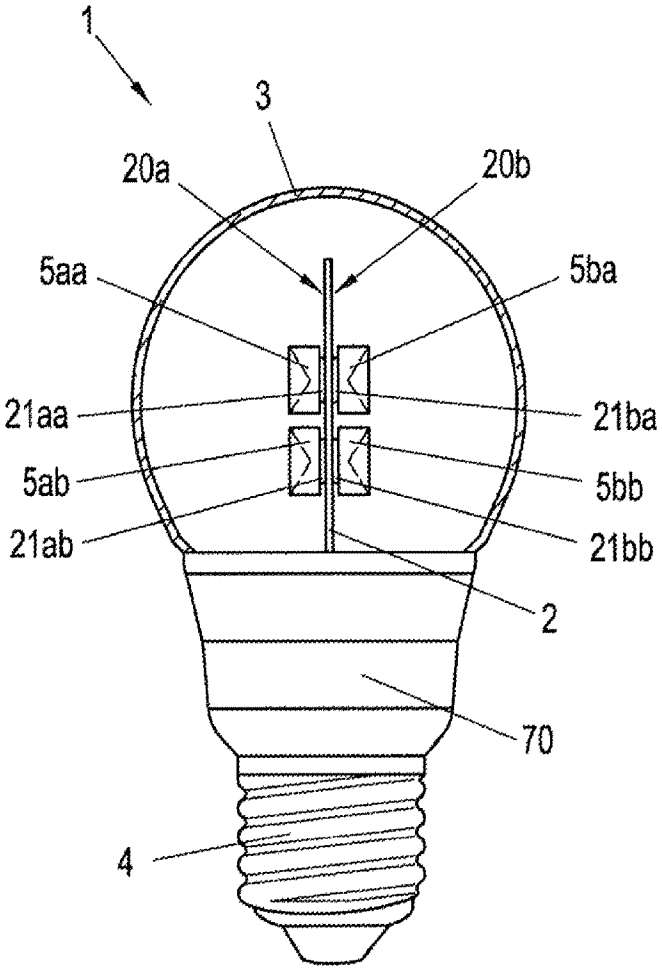
FIG. 7 a second luminous means according to the invention in a partially cutaway side view.

FIG. 7 shows a further luminous means 1 according to the invention, in a partially cutaway side view. Unlike in the luminous means 1 according to FIGS. 1 and 2, in this case two LEDs 21*aa, ab, ba, bb* are provided for each circuit board side 20*a, b*, each of which LEDs has an associated diverging lens 5*aa, ab, ba, bb*, the lenses in this cases being total reflection lenses, unlike in the preceding embodiment.

The luminous means 1 according to FIG. 7 differs from that according to FIGS. 1 and 2 also in terms of mounting. In this case, the outer bulb 3 is made from plastics material and filled with air. The plastics outer bulb 3 is inserted into a housing part 70 in which a heat sink for cooling the circuit board 2 is arranged, see FIG. 10 in detail.

By contrast, the outer bulb 3 of the luminous means 1 according to FIG. 1 is made of glass and filled with a helium-containing filling gas for thermal optimization.

Figure 8:
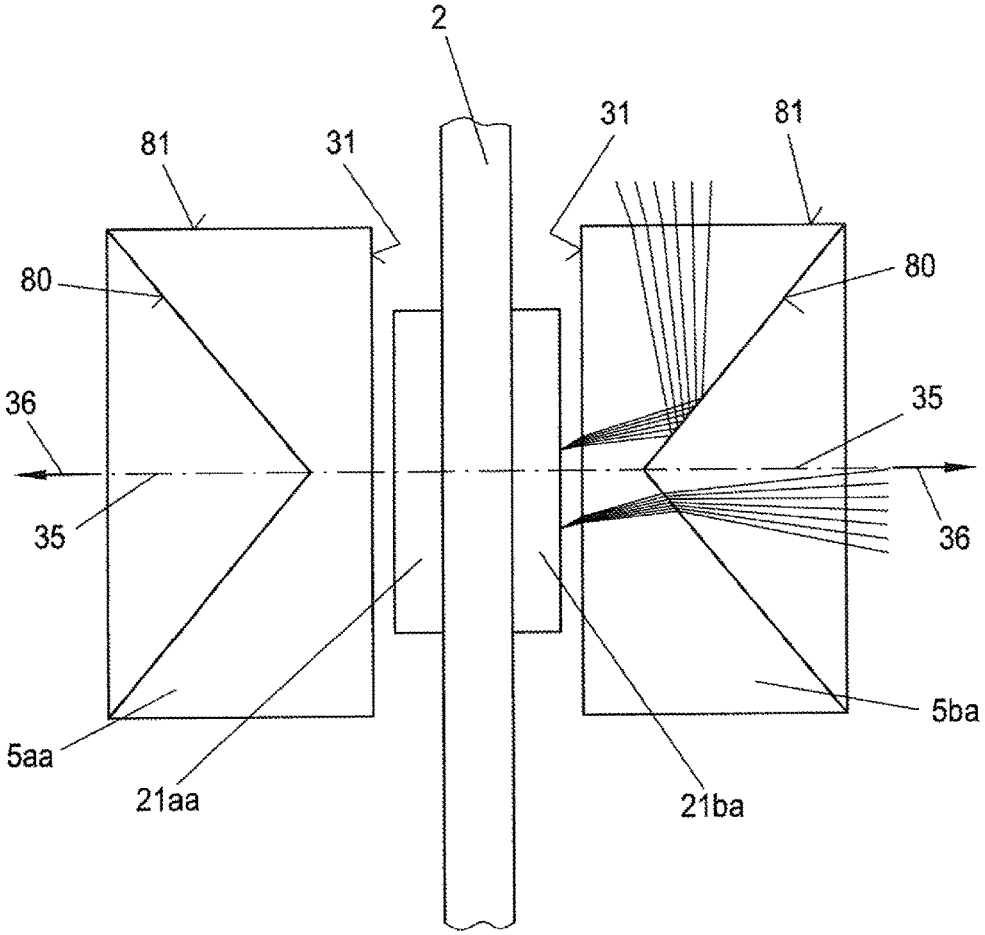
FIG. 8 diverging lenses of the luminous means according to FIG. 7 with beams to illustrate the diverging function.

FIG. 8 shows a detail view of the luminous means 1 according to FIG. 7, namely two of the diverging lenses 5. For the right-hand diverging lens 5*ba* in the Figure, two beams are shown by way of example, which beams illustrate the function. If light is incident on the total reflection surface 80 at an angle of incidence of less than $\theta_c$, it passes through. By contrast, light incident at an angle of incidence greater than $\theta_c$ is totally reflected and thus distributed to the side. As a result, comparably to the diverging lenses 5 according to the luminous means of FIGS. 1 and 2, light is distributed away from the respective LED main propagation direction 36, in the present case by total reflection. This is illustrated by the upper beam in FIG. 8. It exits at a lateral light exit surface 81.

The diverging lenses 5 according to FIGS. 7 and 8 each have a planar light entry surface. In general, this could also be adhesively bonded directly to the respective LED 21, but in the present case it is separated therefrom by an air gap. The diverging lenses 5 are mounted on the circuit board 2 via carriers (not shown).

Figure 9A:
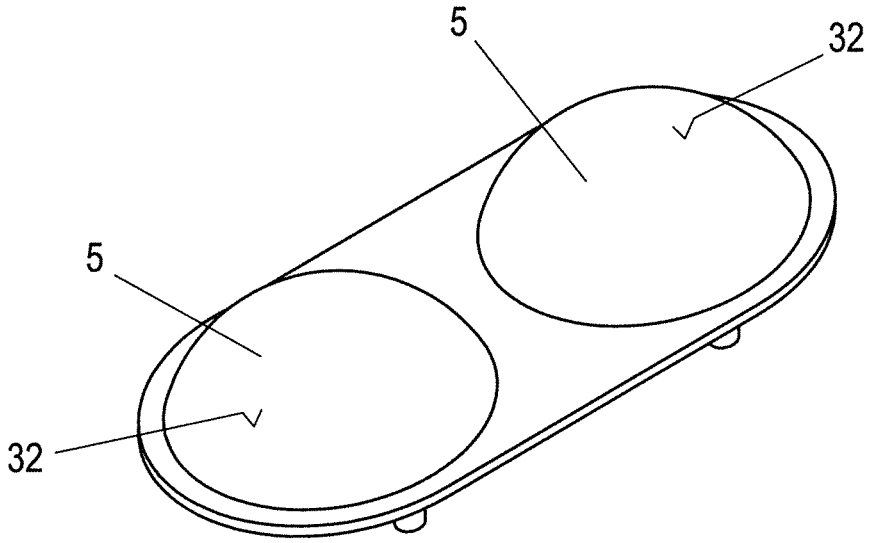
FIG. 9*a, b* diverging lenses for a third luminous means according to the invention having two LEDs for each circuit board side.

FIGS. 9*a, b* show diverging lenses 5 for a further luminous means according to the invention, in which, in correspondence to that according to FIG. 7, two LEDs are provided for each circuit board side 20*a, b*. In contrast to the luminous means 1 according to FIG. 7, however, the diverging lenses 5 according to FIG. 9 scatter the light by means of light refraction at the respective convexly curved light exit surface 32. In this respect, reference is made to the preceding description, in particular relating to FIG. 3.

Figure 9B:
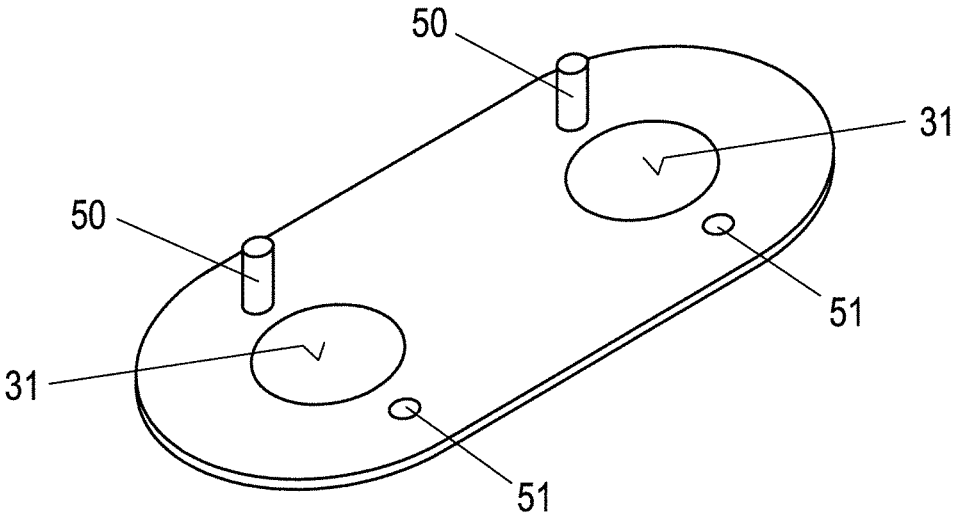

The two diverging lenses 5 according to FIG. 9 are in the form of a monolithic part, such a lens part is then arranged on each circuit board side 20*a, b*. For fixing the diverging lenses 5 to the circuit board 2, pins 50 are again formed monolithically on the diverging lenses 5, which pins then each pass through a respective through-hole in the circuit board 2 and engage in a hole 51 of the diverging lens 5 (or diverging lens part) arranged on the respective opposite circuit board side 20*a, b*. Reference is made to the description relating to FIG. 5.

FIG. 10 illustrates the assembly of the luminous means 1 according to FIG. 7 in a plurality of steps. The outer bulb 3 and the circuit board 2 are initially separate parts. The heat sink 71 is also made from two initially separate heat sink parts 71*a, b* (FIG. 10*a*). In a first step, the two heat sink parts 71*a, b* are fitted to the circuit board 2, thus the heat sink 71 is assembled in its position on the circuit board 2 (FIG. 10*b*).

With the assembly of the heat sink 71, tongues 72 provided on the heat sink are applied to the circuit board 2. Furthermore, the circuit board 2 is provided with a groove 52 into which the heat sink 71 engages. The circuit board 2 and the heat sink 71 are thus fixed in their relative position in relation to the outer bulb longitudinal axis 73.

Figure 10A:
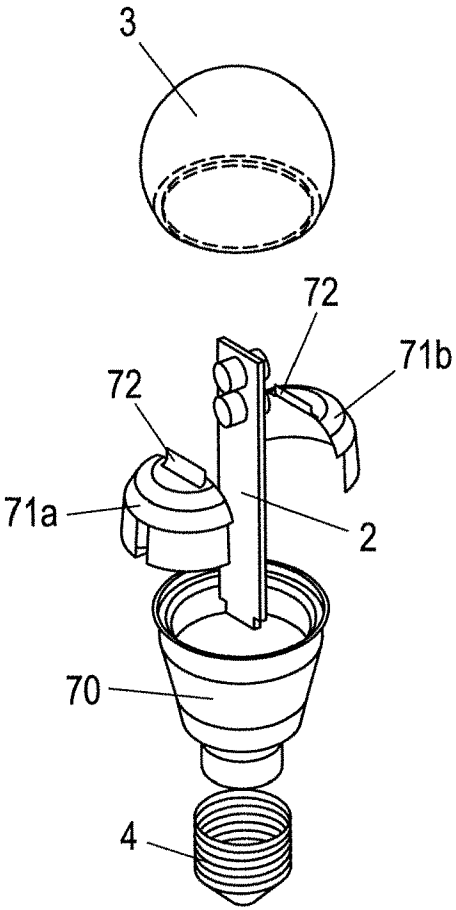
FIG. 10*a-d* the assembly of the luminous means according to FIG. 7 in a plurality of steps.
Figure 10B:
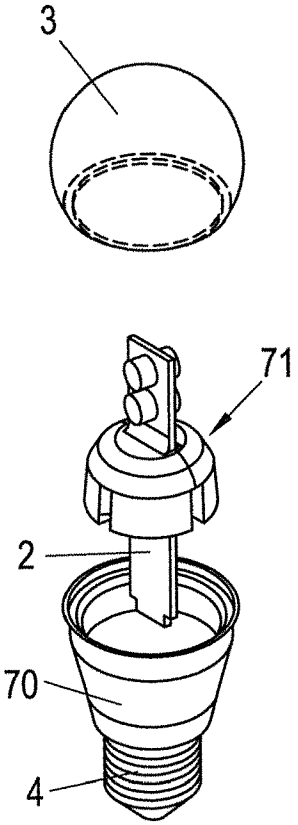
Figure 10C:
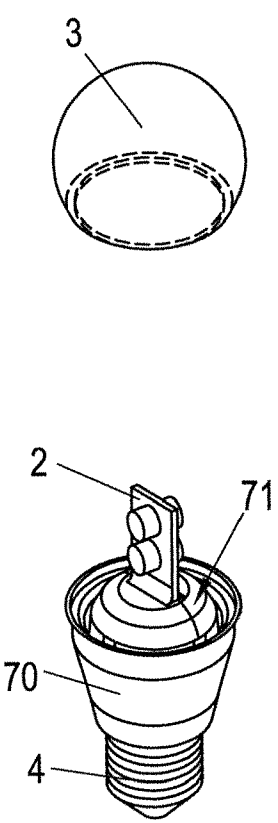
Figure 10D:
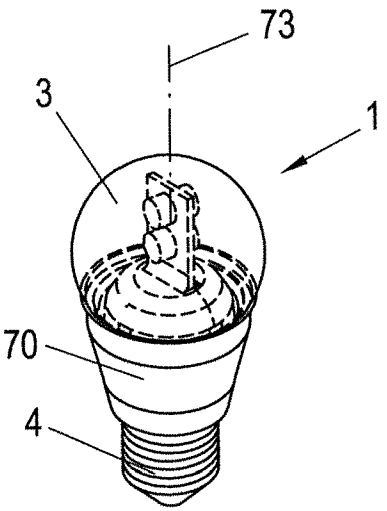

The housing part 70 and the base 4 are initially also separate parts, which are assembled (FIG. 10*b*). In a next step, the unit consisting of the circuit board 2 with the heat sink 71 is pressed into the housing part 70 (along the outer bulb longitudinal axis 73) and is then held therein by an interference fit (FIG. 10*c*).

In a final step (FIG. 10*d*), the outer bulb 3 is fitted, namely inserted to a certain extent into the housing part 70, with a movement along the outer bulb longitudinal axis 73. The outer bulb 3 is then held in an interlocking manner in the housing part 70.

Figure 11:
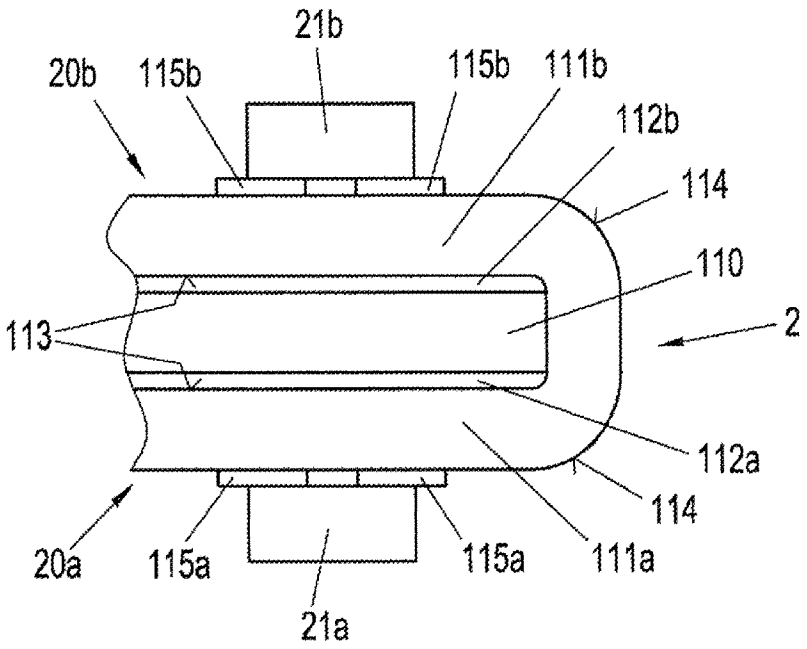
FIG. 11 the circuit board of a luminous means according to the invention in a schematic section.

FIG. 11 shows a multilayer substrate folded from a substrate sheet as a circuit board. The multilayer substrate according to FIG. 11 has a carrier 110, namely an aluminum plate. This serves both to mechanically stabilize the substrate layers 111*a, b* formed from the substrate sheet and to improve the dissipation of heat from the LEDs 21*a, b*. Two joint connecting layers 112*a, b* can also be seen in this schematic section, namely on either side of the carrier 110. By means of each of the joint connecting layers 112*a, b*, in each case one of the substrate layers 111*a, b* is connected to the carrier 110, and thus also to the remainder of the multilayer substrate, by a material-based connection.

For production, an adhesive film can be applied to a side surface 113 of the substrate sheet, which side surface is then remote from the side surface 114 forming the outer side surfaces 20*a, b* of the multilayer substrate. The substrate sheet is then folded around the carrier 110 and thus back on itself. The LEDs 21*a, b* are thereby already mounted on the substrate sheet and in each case electrically conductively connected (for example by means of a low-temperature solder or a conductive adhesive) with conductive tracks 115*a, b* arranged on the side surface 114 thereof.

The invention claimed is:

1. A luminous means having:

a first LED and a second LED for emitting light;

a flat circuit board on which the LEDs are mounted and thereby electrically conductively connected with a conductive track structure of the circuit board;

an outer bulb which is transmissive for the light emitted by the LEDs and in which the circuit board having the LEDs is arranged; and a base with which the LEDs are electrically operably connected via the conductive track structure;

wherein the first LED is mounted on a first side of the circuit board and the second LED is mounted on a second side of the circuit board that is opposite the first side in relation to a thickness direction, wherein all the LEDs mounted on the circuit board are arranged on one of the two circuit board sides; and wherein, in order to homogenize the light distribution generated by the luminous means, a first diverging lens is mounted on the first side of the circuit board in association with the first LED and a second diverging lens is mounted on the second side of the circuit board in association with the second LED, and the light emitted by the respective LED has a widened light intensity distribution downstream of the respective diverging lens in comparison with upstream of the respective diverging lens, wherein the two diverging lenses are connected together by a pin which passes through a through-hole in the circuit board and engages in at least one of the two diverging lenses.

2. The luminous means according to claim 1, in which at least one of the diverging lenses has a total reflection surface, namely on its side remote from the respective LED, at which total reflection surface at least a part of the light emitted by the respective LED is reflected away from a respective LED main propagation direction in which the respective LED emits the light.

3. The luminous means according to claim 1, in which at least one of the diverging lenses has a curved light exit surface at which at least a part of the light emitted by the respective LED is refracted away from a respective LED main propagation direction in which the respective LED emits the light.

4. The luminous means according to claim 1, in which at least one of the diverging lenses has a light entry surface facing the respective LED, which light entry surface is separated from the respective LED by a gas volume.

5. The luminous means according to claim 1, in which the two diverging lenses each have an optical axis, and the optical axis of the first diverging lens coincides with the optical axis of the second diverging lens.

6. The luminous means according to claim 1, in which the pin engages in one of the two diverging lenses and is formed monolithically with the other of the two diverging lenses.

7. The luminous means according to claim 1, in which the two diverging lenses are structurally identical.

8. The luminous means according to claim 1, in which the outer bulb has a longitudinal axis and the LEDs are arranged relative thereto in such a way that for each LED, an LED main propagation direction encloses an angle of at least 80° and at most 100° with a longitudinal direction parallel to the outer bulb longitudinal axis and pointing away from the base towards the outer bulb.

9. The luminous means according to claim 1, in which the light distribution generated with the luminous means is homogenized in that light intensity values taken on a circular path around an outer bulb longitudinal axis at an angle of 90° to an outer bulb longitudinal direction parallel to the outer bulb longitudinal axis and pointing away from the base towards the outer bulb in each case represent at least 30% of a maximum value of the light intensity taken on the circular path.

10. The luminous means according to claim 1, in which the circuit board, at least in some regions, is in multilayer form with at least two substrate layers which are formed from a flat substrate sheet which is laid back on itself, wherein the LEDs arranged on the mutually opposite sides of the circuit board are arranged on the same side surface of the substrate sheet.

11. The luminous means according to claim 10, in which the substrate sheet has a thickness of at least 150 μm and at most 500 μm, and conductive tracks forming the conductive track structure each have a thickness of at least 20 μm and at most 100 μm.

12. The luminous means according to claim 1, having a heat sink which is provided in direct thermal contact with the circuit board and forms an outer surface of the luminous means or is provided in direct thermal contact with a part forming an outer surface of the luminous means, wherein the heat sink has a thermal resistance $R_{th}$ of at most 25 K/W.

13. The luminous means according to claim 12, in which the heat sink is assembled from at least two parts, which heat sink parts together enclose the circuit board.

14. The luminous means according to claim 1, in which the outer bulb is made from glass and delimits a closed volume filled with a filling gas, which filling gas has a higher thermal conductivity than air.

15. The luminous means according to claim 14, in which the circuit board is arranged wholly within the filling gas volume and is preferably free from a driver electronics.

* * * * *